US011325739B2

(12) United States Patent
Requena et al.

(10) Patent No.: US 11,325,739 B2
(45) Date of Patent: May 10, 2022

(54) CARTON

(71) Applicant: Graphic Packaging International, LLC, Atlanta, GA (US)

(72) Inventors: Emili Requena, Igualada (ES); Josep Cano De Miguel, Castelloli (ES)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/372,830

(22) Filed: Apr. 2, 2019

(65) Prior Publication Data

US 2019/0300230 A1 Oct. 3, 2019

Related U.S. Application Data

(60) Provisional application No. 62/659,265, filed on Apr. 18, 2018, provisional application No. 62/651,915, filed on Apr. 3, 2018.

(51) Int. Cl.
*B65D 5/46* (2006.01)
*B65D 5/66* (2006.01)
(Continued)

(52) U.S. Cl.
CPC ..... *B65D 5/4204* (2013.01); *B65D 5/2047* (2013.01); *B65D 5/241* (2013.01);
(Continued)

(58) Field of Classification Search
CPC ..... B65D 2571/0029; B65D 71/16; B65D 81/3869
(Continued)

(56) References Cited

U.S. PATENT DOCUMENTS 2,168,784 A * 8/1939 Raymond ..... B65D 85/34 206/499
2,776,082 A * 1/1957 Bennorth ..... B65D 85/325 206/521.7
(Continued)

FOREIGN PATENT DOCUMENTS

CA 877792 8/1971
CA 2 160 145 9/1995
(Continued)

OTHER PUBLICATIONS

International Search Report and Written Opinion for PCT/US2019/025326 dated Jul. 24, 2019.
(Continued)

*Primary Examiner* — Nathan J Newhouse
*Assistant Examiner* — Phillip D Schmidt
(74) *Attorney, Agent, or Firm* — Womble Bond Dickinson (US) LLP

(57) ABSTRACT

A carton for holding at least one article includes a plurality of panels that extends at least partially around an interior of the carton. The plurality of panels includes a bottom panel, a front panel, a back panel, at least one side panel, and a top panel. The carton further includes a tray formed from the bottom panel, the front panel, the back panel, and the at least one side panel, and the tray is for at least partially receiving the at least one article. The carton further includes a lid formed from the at least one top panel, the lid includes at least one article engaging feature for engaging the at least one article.

49 Claims, 12 Drawing Sheets

(51) Int. Cl.

| | |
|---|---|
| ***B65D 5/24*** | (2006.01) |
| ***B65D 5/42*** | (2006.01) |
| ***B65D 43/16*** | (2006.01) |
| ***B65D 5/20*** | (2006.01) |
| *B65D 85/34* | (2006.01) |

(52) U.S. Cl.
CPC ..... *B65D 5/6655* (2013.01); *B65D 43/162* (2013.01); *B65D 5/4266* (2013.01); *B65D 5/46072* (2013.01); *B65D 85/345* (2013.01); *B65D 2543/00074* (2013.01)

(58) Field of Classification Search
USPC ..... 229/154, 162.6, 103.3, 103.2, 182.1; 206/194, 155, 562–563, 779
See application file for complete search history.

(56) References Cited

U.S. PATENT DOCUMENTS 2,968,392 A * 1/1961 Schwebs ..... B65D 5/2066 229/162.5
2,990,947 A * 7/1961 Forrer ..... B65D 5/28 206/779
3,270,939 A * 9/1966 Ebelhardt ..... B65D 5/3685 229/117.19
3,447,672 A 6/1969 Bailey
3,642,190 A * 2/1972 Glaser ..... B65D 85/325 206/521.7
3,987,893 A * 10/1976 Hanson ..... B65D 5/5009 206/779
4,941,624 A * 7/1990 Schuster ..... B65D 71/36 229/117.13
5,427,241 A 6/1995 Sutherland
5,458,234 A 10/1995 Harris
5,485,915 A 1/1996 Harris
5,495,727 A 3/1996 Strong et al.
5,503,324 A 4/1996 Bacchetti et al.
5,524,756 A 6/1996 Sutherland
5,551,556 A 9/1996 Sutherland
5,582,343 A 12/1996 Dalvey
5,639,017 A 6/1997 Fogle
5,647,483 A 7/1997 Harris
5,669,500 A 9/1997 Sutherland
5,699,957 A 12/1997 Blin et al.
5,704,470 A 1/1998 Sutherland
5,738,273 A 4/1998 Auclair
D394,385 S 5/1998 Laughlin
5,794,778 A 8/1998 Harris
5,819,920 A * 10/1998 Sutherland ..... B65D 71/0022 206/174
5,826,782 A 10/1998 Stout
5,873,515 A 2/1999 Dunn et al.
5,878,946 A 3/1999 Frerot et al.
5,915,546 A 6/1999 Harrelson
5,947,367 A * 9/1999 Miller ..... B65D 71/36 206/427
5,992,733 A 11/1999 Gomes
5,996,883 A 12/1999 Bates
6,019,276 A 2/2000 Auclair
6,065,590 A 5/2000 Spivey
6,105,853 A 8/2000 Lamare
6,105,854 A 8/2000 Spivey et al.
6,131,803 A 10/2000 Oliff et al.
6,164,526 A 12/2000 Dalvey
D436,315 S 1/2001 Bentolila
6,170,741 B1 1/2001 Skolik et al.
6,227,367 B1 5/2001 Harrelson et al.
6,237,839 B1 5/2001 Brown
6,241,083 B1 6/2001 Harrelson
6,260,755 B1 7/2001 Bates et al.
6,302,320 B1 10/2001 Stout
6,422,453 B1 7/2002 Wang
6,425,520 B1 7/2002 Peterson
6,523,739 B2 2/2003 Heeley et al.
6,536,656 B2 3/2003 Auclair et al.
6,598,784 B2 7/2003 LaBras et al.
6,631,803 B2 10/2003 Rhodes et al.
6,758,337 B2 7/2004 Chargueraud et al.
D496,265 S 9/2004 Dossett
6,848,573 B2 2/2005 Gould et al.
6,905,066 B2 6/2005 Holley, Jr. et al.
6,926,193 B2 8/2005 Smalley
7,007,836 B2 3/2006 Smalley
D534,071 S 12/2006 Hoff
7,427,010 B2 9/2008 Sutherland
7,472,791 B2 1/2009 Spivey, Sr.
D590,257 S 4/2009 Matsumoto
7,617,969 B2 11/2009 Oliveira
7,743,968 B2 6/2010 Theelen
7,748,603 B2 7/2010 Fogle et al.
7,757,933 B2 7/2010 Dunn
7,806,314 B2 10/2010 Sutherland
D668,965 S 10/2012 Crawford
8,365,920 B2 * 2/2013 House ..... B65D 5/029 206/430
8,439,253 B2 5/2013 Requena et al.
D693,242 S 11/2013 Birchmeier
D694,125 S 11/2013 Holsmer
D695,634 S 12/2013 Holsmer
D703,527 S 4/2014 Fuller
8,740,050 B2 6/2014 Zinck et al.
D709,953 S 7/2014 Williams
D710,213 S 8/2014 Birchmeier
D711,218 S 8/2014 Jacobs
D723,022 S 2/2015 Miles
D730,748 S 6/2015 Varavarna
9,211,971 B2 12/2015 Fogle et al.
D760,598 S 7/2016 White
D764,281 S 8/2016 Mayer
D792,761 S 7/2017 Duval et al.
D798,707 S 10/2017 Mayer
D798,736 S 10/2017 Shoshan
D798,737 S 10/2017 Miller
D809,911 S 2/2018 Moskovich et al.
D826,706 S 8/2018 Moskovich
D828,766 S 9/2018 Latour
D828,768 S 9/2018 Lebeau
D833,860 S 11/2018 Lee
D833,865 S 11/2018 Petty
D839,729 S 2/2019 Oliveira
2001/0017314 A1 8/2001 Boukredine et al.
2003/0213263 A1 11/2003 Woog
2004/0074954 A1 4/2004 Fogle et al.
2005/0056658 A1 3/2005 Spivey
2005/0167478 A1 8/2005 Holley, Jr.
2006/0169755 A1 8/2006 Spivey
2006/0273143 A1 12/2006 Finch
2007/0039846 A1 2/2007 Spivey
2007/0051781 A1 3/2007 Holley
2007/0108261 A1 5/2007 Schuster
2007/0125897 A1 6/2007 Wijerama
2007/0164091 A1 7/2007 Fogle et al.
2007/0205255 A1 9/2007 Dunn
2007/0295789 A1 12/2007 Ho Fung
2008/0067223 A1 3/2008 Jego
2009/0014508 A1 1/2009 Marie
2009/0090708 A1 4/2009 Requena
2009/0236408 A1 9/2009 Spivey, Sr. et al.
2010/0147932 A1 6/2010 Brand
2012/0091190 A1 * 4/2012 Smalley ..... B65D 71/14 229/117.13
2016/0244231 A1 * 8/2016 Alexander ..... B65D 5/5059
2017/0125897 A1 * 5/2017 Rubin ..... H01Q 1/50
2019/0225398 A1 * 7/2019 Smalley ..... B65D 71/22

FOREIGN PATENT DOCUMENTS

CH 536 757 5/1973
DE 85 14 718 6/1985
DE 93 13 241 12/1993
DE 9318671 U1 * 2/1994 ..... B65D 5/2033
DE 93 20 497 U1 11/1994
DE 296 07 374 7/1996

(56) References Cited

FOREIGN PATENT DOCUMENTS

| | | |
|---|---|---|
| DE | 201 12 228 | 11/2002 |
| DE | 20 2004 018 649 | 5/2005 |
| EP | 0 473 266 | 3/1992 |
| EP | 0 500 258 | 8/1992 |
| EP | 1 381 545 | 1/2004 |
| EP | 1 612 157 | 1/2006 |
| FR | 48.351 E | 2/1938 |
| FR | 2 481 231 | 10/1981 |
| FR | 2 662 141 | 11/1991 |
| GB | 2 206 565 | 1/1989 |
| JP | 2004-521032 | 7/2004 |
| KR | 10-0785977 | 12/2007 |
| OA | 128 | 1/1966 |
| WO | WO 81 00090 | 1/1981 |
| WO | WO 95/11165 | 4/1995 |
| WO | WO 96/20874 | 7/1996 |
| WO | WO 96/21604 | 7/1996 |
| WO | WO 96/27538 | 9/1996 |
| WO | WO 99/28207 | 6/1999 |
| WO | WO 00/78618 | 12/2000 |
| WO | WO 01/66434 | 9/2001 |
| WO | WO 02/47990 | 6/2002 |
| WO | WO 02/085739 | 10/2002 |
| WO | WO 03/037742 | 5/2003 |
| WO | WO 2005/080218 | 9/2005 |
| WO | WO 2005/123532 | 12/2005 |
| WO | WO 2007/089282 | 8/2007 |

OTHER PUBLICATIONS

Cowberry Crossing Farm Egg Packaging on Behance. [online] Published Dec. 8, 2016. Retrieved Feb. 4, 2019 from URL: https://www.behance.net/gallery/22325357/Cowberry-Crossing-Farm-Egg-Packaging.

Unique packaging for apples. [online] Published Nov. 11, 2014. Retrieved Feb. 4, 2019 from URL: https://www.freshplaza.com/article/130798/Unique-packaging-for-apples/.

Efficient Fruit Packaging fruit packaging. [online] Published Jul. 10, 2014. Retrieved Feb. 4, 2019 from URL: https://www.trendhunter.com/trends/fruit-packaging.

Graphic Packaging International on sustainable packaging. [online] Retrieved Feb. 11, 2019 from URL: https://qualityfoodawards.com/news/interview-graphic-packaging-international-on-sustainable-packaging-01-05-2018/.

Supplementary European Search Report for EP 19 78 2146 dated Dec. 10, 2021.

* cited by examiner

CARTON

CROSS-REFERENCE TO RELATED APPLICATIONS

This application claims the benefit of each of U.S. Provisional Patent Application No. 62/651,915, filed on Apr. 3, 2018, and U.S. Provisional Patent Application No. 62/659,265, filed on Apr. 18, 2018.

INCORPORATION BY REFERENCE

The disclosures of each of U.S. Provisional Patent Application No. 62/651,915, filed on Apr. 3, 2018, and U.S. Provisional Patent Application No. 62/659,265, filed on Apr. 18, 2018, are hereby incorporated by reference for all purposes as if presented herein in their entirety.

BACKGROUND OF THE DISCLOSURE

The present disclosure relates to cartons, blanks for forming cartons, and associated methods. In one embodiment, the present disclosure relates to a carton with a reclosable lid for retaining at least one article in the carton.

SUMMARY OF THE DISCLOSURE

According to one aspect of the disclosure, a carton for holding at least one article comprises a plurality of panels that extends at least partially around an interior of the carton, the plurality of panels comprising a bottom panel, a front panel, a back panel, at least one side panel, and a top panel. The carton further comprises a tray formed from the bottom panel, the front panel, the back panel, and the at least one side panel, and the tray is for at least partially receiving the at least one article. The carton further comprises a lid formed from the at least one top panel, the lid comprising at least one article engaging feature for engaging the at least one article.

According to another aspect of the disclosure, a blank for forming a carton for holding at least one article comprises a plurality of panels for extending at least partially around an interior of the carton formed from the blank, the plurality of panels comprising a bottom panel, a front panel, a back panel, at least one side panel, and a top panel. The bottom panel, the front panel, the back panel, and the at least one side panel are for forming a tray in the carton formed from the blank, and the tray is for at least partially receiving the at least one article. The at least one top panel is for forming a lid in the carton formed from the blank, the lid comprising at least one article engaging feature for engaging the at least one article.

According to another aspect of the disclosure, a method of forming a carton for holding at least one article comprises obtaining a blank, the blank comprising a plurality of panels that extends at least partially around an interior of the carton, the plurality of panels comprising a bottom panel, a front panel, a back panel, at least one side panel, and a top panel. The method further comprises at least partially folding the bottom panel, the front panel, the back panel, and the at least one side panel to form a tray, the tray is for at least partially receiving the at least one article. The method further comprises forming a lid from the at least one top panel, the lid comprising at least one article engaging feature for engaging the at least one article.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Cartons according to the present disclosure can accommodate articles of numerous different shapes. For the purpose of illustration and not for the purpose of limiting the scope of the disclosure, the following detailed description describes articles such as food products, e.g., fruit or vegetable items. In one embodiment, articles described herein can be fruits such as apples, oranges, tangerines, clementines, lemons, limes, etc. In another embodiment, articles described herein can be product packages, containers, bottles, cans, etc., that are at least partially disposed within the carton embodiments. The articles can be used for packaging food and beverage products, for example. Packaged articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; composite materials; and the like, or any combination thereof.

Cartons according to the present disclosure can accommodate articles of any shape. For the purpose of illustration and not for the purpose of limiting the scope of the disclosure, the following detailed description describes generally round or ovoid food products. The articles described herein can include different types of food or beverage products, containers thereof, and/or having different shapes, without departing from the disclosure. In this specification, the terms "lower," "bottom," "upper," and "top" indicate orientations determined in relation to fully erected and upright cartons. As described herein, cartons can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
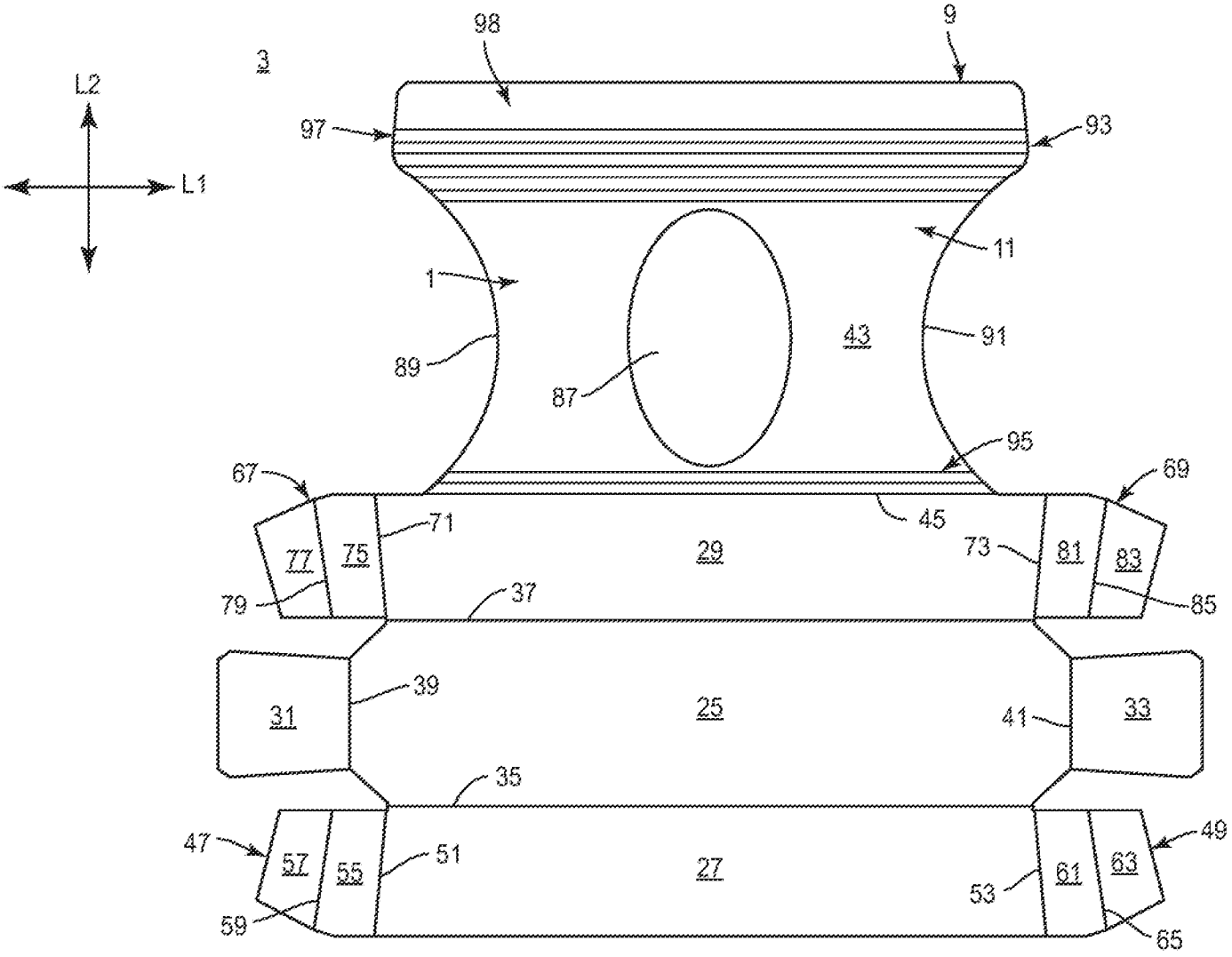
FIG. 1 is a plan view of an exterior surface of a blank for forming a carton according to a first exemplary embodiment of the disclosure.

FIG. 1 is a plan view of an exterior surface 1 of a blank 3 that can be obtained for forming a carton 5 (FIG. 2) according to a first exemplary embodiment of the disclosure. The carton 5 is provided to extend at least partially around an interior 7 of the carton 5 for holding at least one article F contained therein, for example, a food product. In one embodiment, the carton 5 has a reclosable lid 9 that includes at least one article retention feature 11 for engaging at least one article F.

The blank 3, as shown, has a longitudinal axis L1 and a lateral axis L2. The illustrated blank 3 includes a bottom panel 25 that is foldably connected to a respective front panel 27, a back panel 29, a first side panel 31, and a second side panel 33 at respective fold lines 35, 37, 39, 41, with the fold lines 35, 37 being longitudinal fold lines and the fold lines 39, 41 being lateral fold lines. A top panel 43, as shown, is foldably connected to the back panel 29 at a longitudinal fold line 45, and, as described further herein, forms the lid 9 of the carton 5.

Still referring to FIG. 1, a first end flap 47 and a second end flap 49 are each foldably connected to the front panel 27 at respective oblique fold lines 51, 53. The first end flap 47 includes a proximal section 55 foldably connected to the front panel 27 at the fold line 51, and a distal section 57 foldably connected to the proximal section 55 at an oblique fold line 59. Similarly, the second end flap 49 includes a proximal section 61 foldably connected to the front panel 27 at the fold line 53, and a distal section 63 foldably connected to the proximal section 61 at an oblique fold line 65. As also shown, a third end flap 67 and a fourth end flap 69 are each foldably connected to the back panel 29 at respective oblique fold lines 71, 73. The third end flap 67 includes a proximal section 75 foldably connected to the back panel 29 at the fold line 71, and a distal section 77 foldably connected to the proximal section 75 at an oblique fold line 79. Similarly, the fourth end flap 69 includes a proximal section 81 foldably connected to the back panel 29 at the fold line 73, and a distal section 83 foldably connected to the proximal section 81 at an oblique fold line 85.

With continued reference to FIG. 1, the top panel 43 includes the article retention features 11, which include an article retaining opening 87 and a pair of curved notches 89, 91 (broadly, "first curved notch" and "second curved notch", respectively) at respective and opposed free edge portions (broadly, "first free edge portion" and "second free edge portion", respectively) of the top panel 43. As also shown, the top panel 43 includes a first plurality of longitudinal fold lines 93 on an interior of a distal portion 97 (e.g., spaced away from a distal free edge) of the top panel 43, and a second plurality of longitudinal fold lines 95 on an interior of a proximal portion 96 (e.g., spaced away from the fold line 45) of the top panel 43. In one embodiment, one or more fold lines of the plurality of fold lines 95 can be collinear with the fold line 45, or the plurality of fold lines 95 can include the fold line 45. As described further herein, the pluralities of fold lines 93, 95 can facilitate formation of the top panel 43 into the lid 9 having an at least partially curved or arched configuration such that the lid 9 is in engagement with one or more of the articles F. In this regard, the pluralities of fold lines 93, 95 each comprise a selected number of laterally spaced longitudinal fold lines to facilitate a desired degree of flexible reconfiguration of the top panel 43.

Any of the panels, flaps, fold lines, cuts, or other features of the blank 3 could be otherwise shaped, arranged, and/or omitted from the blank 3 without departing from the disclosure. For example, one or more of the fold lines 35, 37, 39, 41, 45, 51, 53, 59, 65, 71, 73, 79, 85 and/or one or more fold line of the pluralities of fold lines 93, 95 can have a different configuration, e.g., one or more of a longitudinal, lateral, oblique, and a curved configuration. The blank 3 can be sized and/or shaped to accommodate a desired number of articles F.

Figure 2:
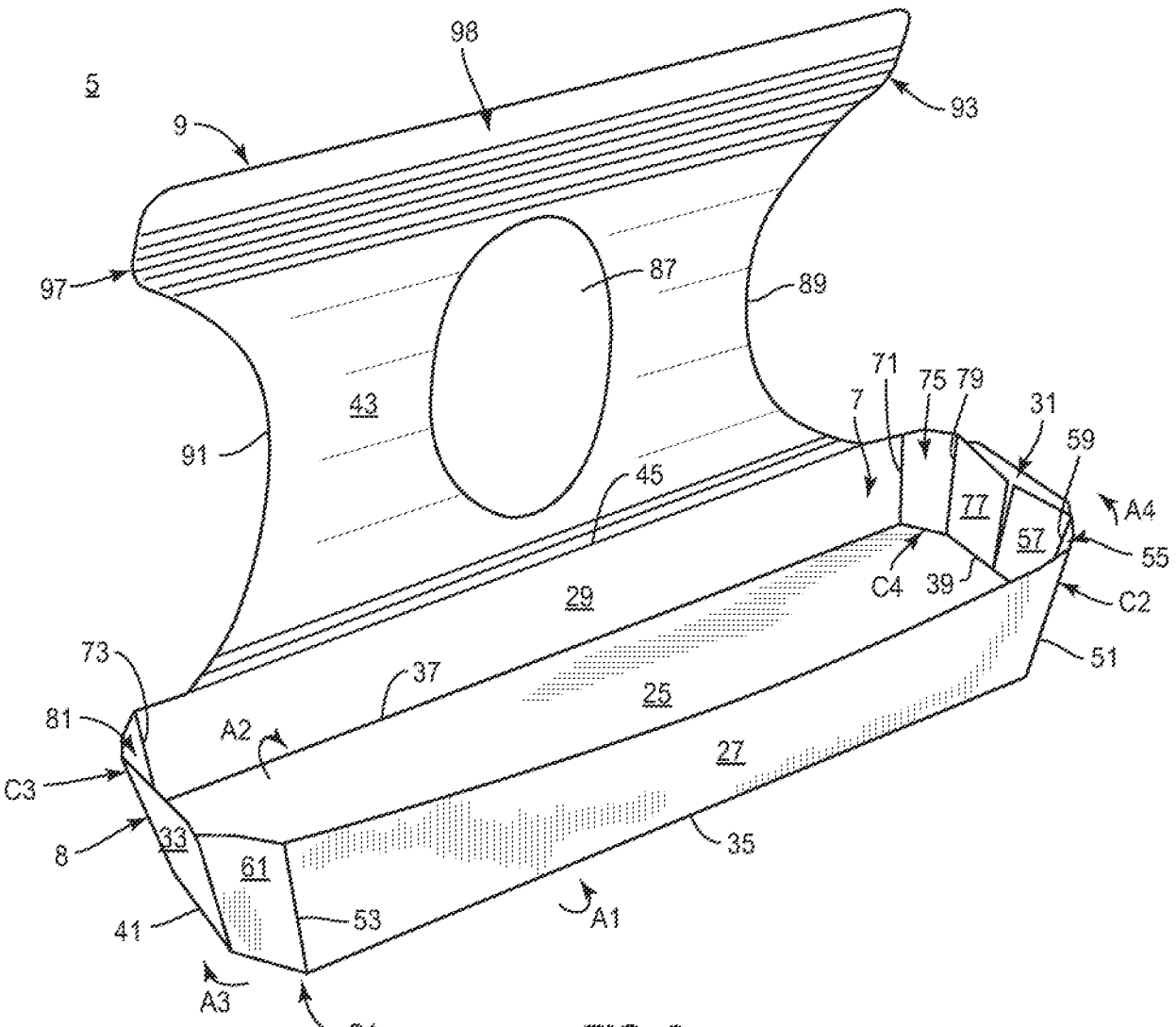
FIG. 2 is a perspective view of a carton formed from the blank of FIG. 1 according to the first exemplary embodiment of the disclosure and in an open configuration.

Referring additionally to FIG. 2, in one embodiment, the panels 25, 27, 39, 31, 33, 43 can be at least partially folded around the interior 7 of the carton 5 to form the carton 5 from the blank 3. In one embodiment, the front panel 27, the back panel 29, the side panel 33, and the side panel 31 are each folded at the respective fold lines 35, 37, 41, 39 in the direction of the respective arrows A1, A2, A3, A4 into a generally upright and oblique arrangement relative to the bottom panel 25, so as to generally form a tray 8 for at least partially receiving one or more article F. The respective end flaps 47, 49 can be folded at the respective fold lines 51, 53 into at least partial oblique relation with the front panel 27, with the proximal portion 55 of the end flap 47 at least partially folded relative to the distal portion 57 at the fold line 59 such that the distal portion 57 is positioned in at least partial face-to-face contact with the side panel 31, and with the proximal portion 61 of the end flap 49 at least partially folded relative to the distal portion 63 at the fold line 65 such that the distal portion 63 is positioned in at least partial face-to-face contact with the side panel 33. Similarly, the respective end flaps 67, 69 can be folded into at least partial oblique relation with the back panel 29 at the respective fold lines 71, 73, with the proximal portion 75 of the end flap 67 at least partially folded relative to the distal portion 77 at the fold line 79 such that the distal portion 77 is positioned in at least partial face-to-face contact with the side panel 31, and with the proximal portion 81 of the end flap 69 at least partially folded relative to the distal portion 83 at the fold line 85 such that the distal portion 83 is positioned in at least partial face-to-face contact with the side panel 33. The distal portions 57, 77 of the respective end flaps 47, 67 and the distal portions 63, 83 of the respective end flaps 49, 69 can be secured to the respective side panels 31, 33 with an adhesive such as glue.

As shown, the respective arrangements of the proximal portion 61 and the distal portion 63 of the end flap 49, the proximal portion 55 and the distal portion 57 of the end flap 47, the proximal portion 81 and the distal portion 83 of the end flap 69, and the proximal portion 75 and the distal portion 77 of the end flap 67 can form respective chamfered or contoured corners C1, C2, C3, C4 (broadly, respective "first corner", "second corner", "third corner", "fourth corner") of the carton 5. One or more of the corners C1, C2, C3, C4 can have a different configuration, for example, an at least partially curved configuration, without departing from the disclosure.

In one embodiment, the carton 5 comprises the tray 8 and the lid 9 foldably connected to the tray 8. In the first or open configuration of the carton 5 illustrated in FIG. 2, the lid 9 is raised above the tray 8, e.g., relative to the upper edges of the panels 27, 29, 31, 33, such that the tray 8 is substantially open and an interior 7 of the carton 5 is accessible. One or more articles F (FIG. 3) can be placed in the tray 8, and the corners C1, C2, C3, C4 can be contoured to conform to a configuration of the outermost articles F. In one embodiment, the carton 5 can be provided with interior features, e.g., dividers or base supports, to support one or more of the articles F. While the articles F can be arranged in one row of three articles (1×3 configuration) in the tray 8, the carton 5 can accommodate other arrangements of articles without departing from the disclosure.

Figure 3:
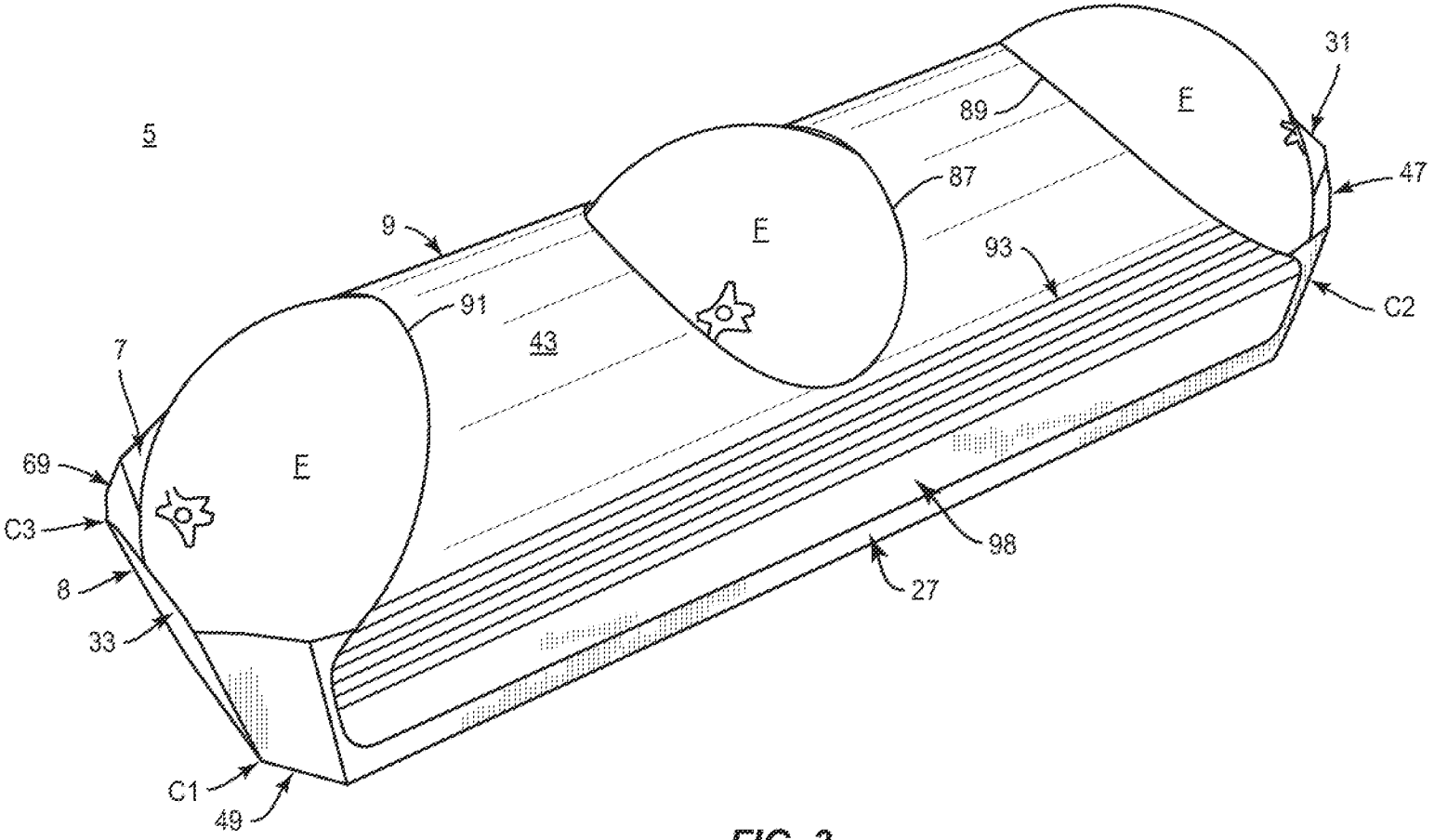
FIG. 3 is a perspective view of the carton of FIG. 2 in a closed configuration.

As shown in FIG. 3, the lid 9 can be folded downwardly at the fold line 45 to at least partially cover the tray 8 and to close the tray 8 and the interior 7 of the carton 5 in a second or closed configuration of the carton 5. As shown, the top panel 43 forming the lid 9 can at least partially bend, curve, or contour about a portion of the articles F via relative flexible reconfiguration of portions of the top panel 43 at the pluralities of fold lines 93, 95 in the closed configuration of the carton 5. One or both of the pluralities of fold lines 93, 95 can include a desired number of fold lines to provide a desired amount of curvature of the lid 9 upon closure as described above.

As also shown, the carton 5 is provided with attachment features that include an attachment portion 98 in the distal portion 97 of the top panel 43 that can be defined between the plurality of fold lines 93 and a free edge of the top panel 43. The attachment portion 98 can be positioned in face-to-face contact with the front panel 27 and secured thereto, for example, with an adhesive such as glue, to maintain the closed configuration of the carton 5. In order to open the carton 5 from such an arrangement, the top panel 43 can be separated from the front panel 27 so that the lid 9 can be lifted at the fold line 45. In one embodiment, the attachment features of the carton 5 can include closure or locking features to maintain the closed condition of the lid 9.

As illustrated, the article retention features 11 engage the one or more articles F in the carton 5 in the closed configuration such that the article retention opening 87 receives and/or engages a portion of the central article F therethrough and the free edge portions or curved notches 89, 91 circumferentially engage a portion of a respective outermost article F. In such an arrangement, portions of the top panel 43 are interspersed between adjacent articles F, with portions of the articles F extending upwardly through the respective opening 87 and notches 89, 91. In this regard, the article retention features 11 receive and/or circumferentially engage the one or more articles F to retain the one or more articles F in the interior 7 of the carton 5 and/or to maintain the relative positioning of the one or more articles F in the tray 8 of the carton 5. Additionally, the protrusion of one or more portions of the respective articles F through the respective article retention features 11 can, for example, to provide areas of inspection or visibility of the articles F to a customer.

Figure 4:
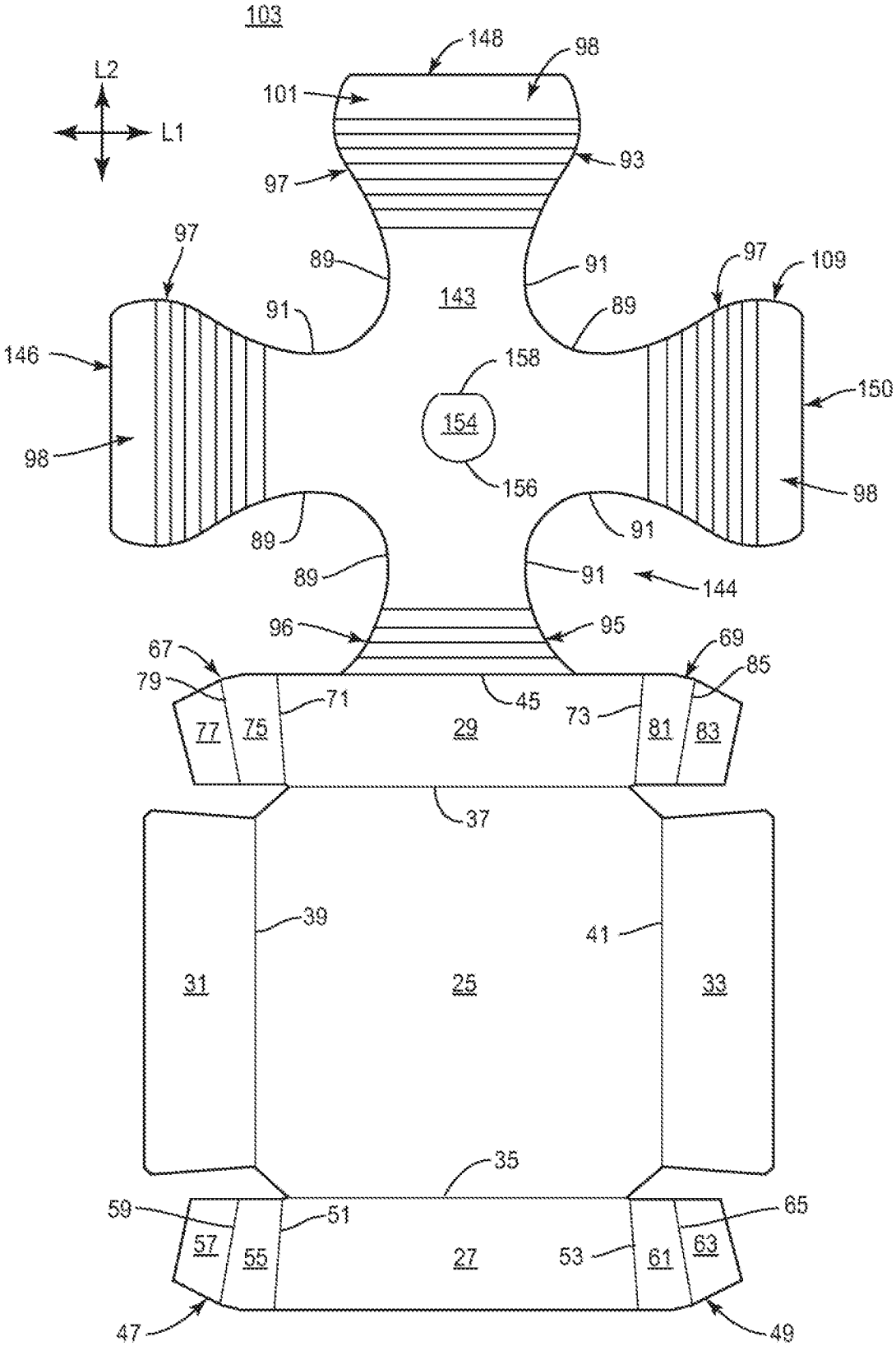
FIG. 4 is a plan view of an exterior surface of a blank for forming a carton according to a second exemplary embodiment of the disclosure.

Turning to FIG. 4, an exterior surface 101 of a blank 103 for forming a carton 105 (FIG. 5) according to a second exemplary embodiment of the disclosure is illustrated. The blank 103 and the carton 105 have one or more features that are similar to the blank 3 (FIG. 1) and the carton 5 (FIG. 2) of the first exemplary embodiment, and identical or similar features are identified with identical or similar reference numerals. The carton 105 includes a tray 108 and a reclosable lid 109 foldably attached to the tray 108 and having article retention features 111. In one embodiment, the carton 105 is sized to hold four articles F in a 2×2 arrangement, but the carton 105 could be sized to hold other quantities of articles in various arrangements without departing from the disclosure.

As shown, the blank 103 has the longitudinal axis L1 and the lateral axis L2. In one embodiment, the lid 109 of the carton 105 is formed from a top panel 143 that includes a plurality of article retention sections 144, 146, 148, 150, (broadly, respective "first article retention section", "second article retention section", "third article retention section", "fourth article retention section") that extend from a central section 151 of the lid 109.

The article retention section 144 comprises a proximal portion 196 foldably connected to the back panel 29 at the fold line 45, and the article retention sections 146, 148, and 150 extend outwardly from the central section 151 to respective free edge portions of the top panel 143. The article retention section 144 comprises a plurality of parallel and spaced fold lines 195 on an interior portion of the proximal portion 196 thereof, and each of the illustrated article retention sections 146, 148, 150 comprises a respective distal portion 197 that includes a respective plurality of parallel and spaced fold lines 193 on an interior portion of the respective distal portions 197, and a respective attachment portion 198 defined between an edge of the respective article retention section 146, 148, 150 and the respective fold lines 193. In addition, the article retention sections 144, 146, 148, 150 are arranged such that a curved notch 189 is defined between respective adjacent article retention sections 144, 146, 148, 150, and which also form the article retention features of the carton 105. In this regard, respective adjacent article retention sections 144, 146, 148, 150 are spaced apart by the respective notches 189.

The top panel 143 also includes a handle feature including a handle flap 154 at least partially formed by a curved cut 156 and foldably attached to the top panel 143 at a longitudinal fold line 158 such that the handle flap 154 can be at least partially separated from the top panel 143 to form a handle opening.

Figure 5:
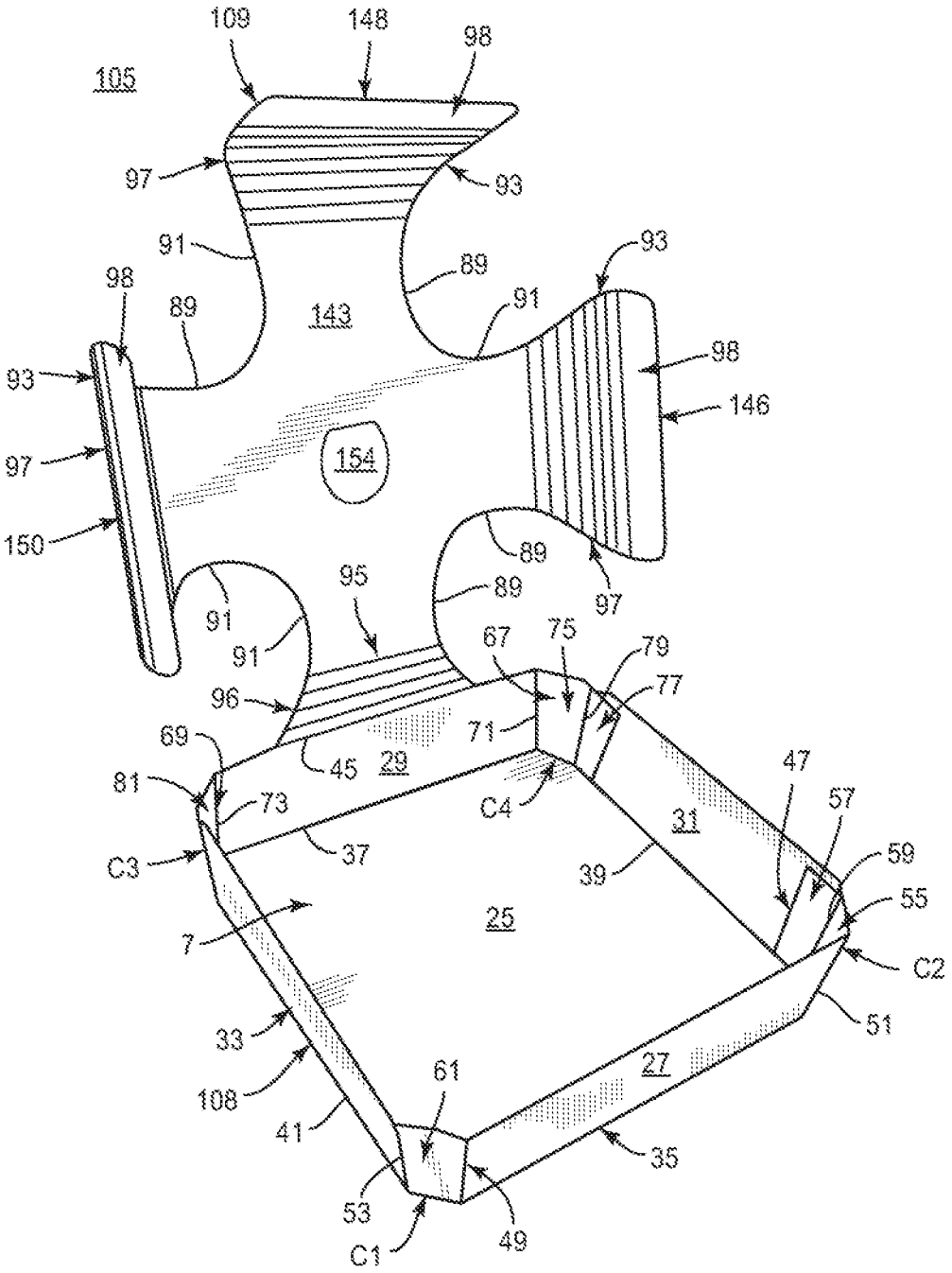
FIG. 5 is a perspective view of a carton formed from the blank of FIG. 4 according to the second exemplary embodiment of the disclosure and in an open configuration.

Referring additionally to FIG. 5, in one embodiment, the panels 25, 27, 39, 31, 33, 143 can be at least partially folded around the interior 7 of the carton 105 in a manner similar to that described above with regard to the carton 5 (FIG. 2) to form the tray 108 of the carton 105 from the blank 103.

In the first or open configuration of the carton 105 illustrated in FIG. 5, the lid 109 is raised above the tray 108, e.g., above the upper edges of the panels 27, 29, 31, 33, such that the interior 7 of the carton 105 is accessible such that one or more articles F (FIG. 6) can be placed in the interior 7 of the carton 105, and with the corners C1, C2, C3, C4 contoured to conform to a configuration of the respective articles F.

Figure 6:
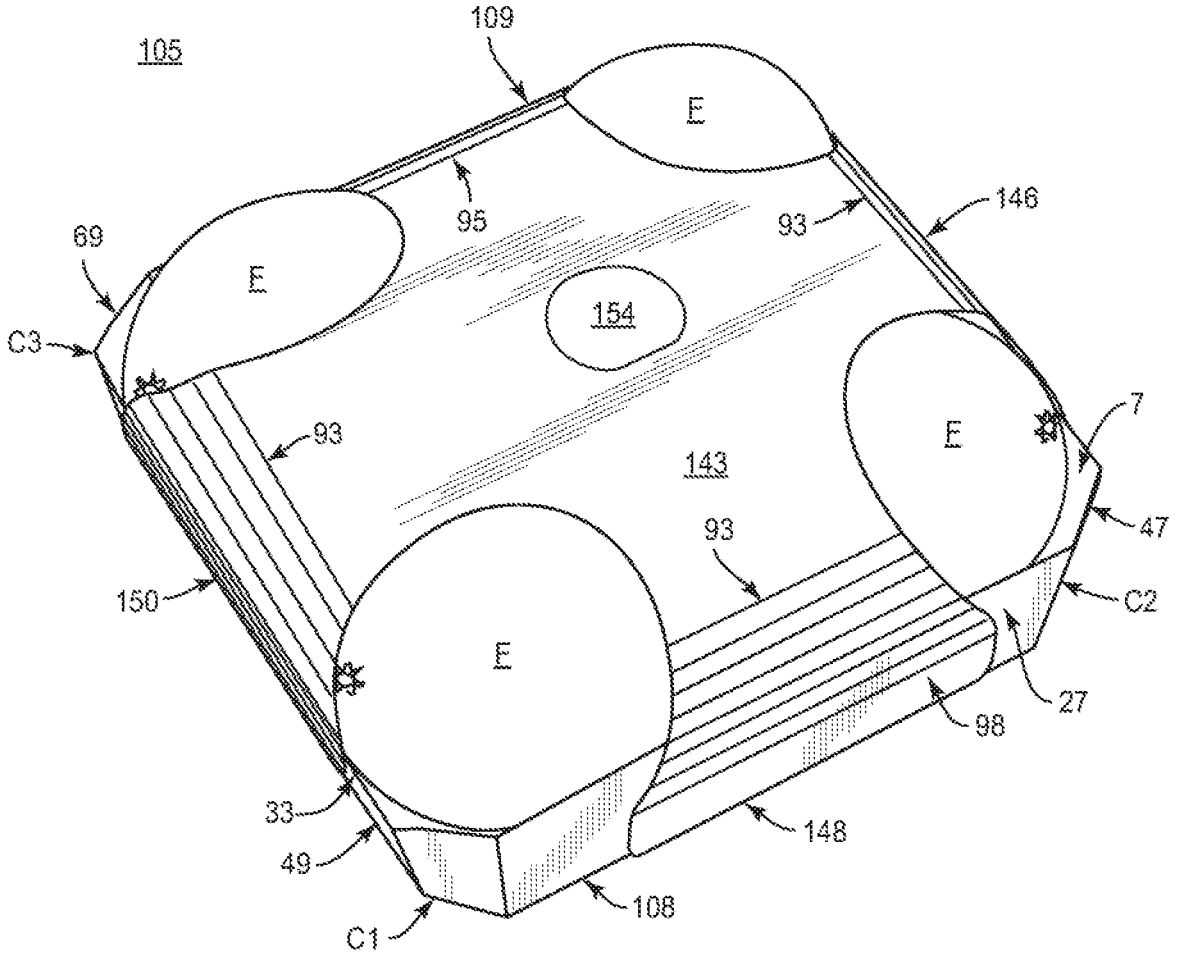
FIG. 6 is a perspective view of the carton of FIG. 5 in a closed configuration.

As shown in FIG. 6, the lid 109 can be folded downwardly at the fold line 45 to at least partially cover the tray 108 and the interior 7 of the carton 105 in a second or closed configuration. As shown, the top panel 143 can at least partially bend, curve, or contour about a portion of the articles F via relative folding of portions of the top panel 143 at the respective pluralities of fold lines 193, 195. As also shown, the respective attachment portions 198 of the respective article retention sections 146, 148, 150 of the top panel 143 can be positioned in face-to-face contact with the respective side panel 33, side panel 31, and front panel 27, and secured thereto, for example, with an adhesive such as glue, to maintain the closed configuration of the carton 105. The carton 105 can additionally or alternatively be provided with closure or locking features as described above with respect to the carton 5. In order to open the carton 105 from such an arrangement, the top panel 143 can be separated from the front panel 27.

As illustrated, the article retention features 111 retain the one or more articles F in the carton 105 such that the article retention sections 144, 146, 148, 150 engage a portion of the articles F, for example, to maintain a stable arrangement of the articles F in the tray 108. In such an arrangement, portions of one or more of the articles F protrude outwardly from the top panel 143, for example, through respective curved notches 198, and the top panel 143 can be interspersed between adjacent articles F. In this regard, the article retention features 111 receive and/or engage the one or more articles F to retain the one or more articles F in the interior 7 of the carton 105 and/or to maintain the relative positioning of the one or more articles F in the carton 105. Additionally, the configuration of the article retention features 111 is such that one or more portions of the articles F protrude therethrough, for example, to provide areas of inspection or visibility of the articles F for a customer. In one embodiment, the articles F are positioned at or adjacent a respective corner C1, C2, C3, C4 of the carton 105.

Figure 7:
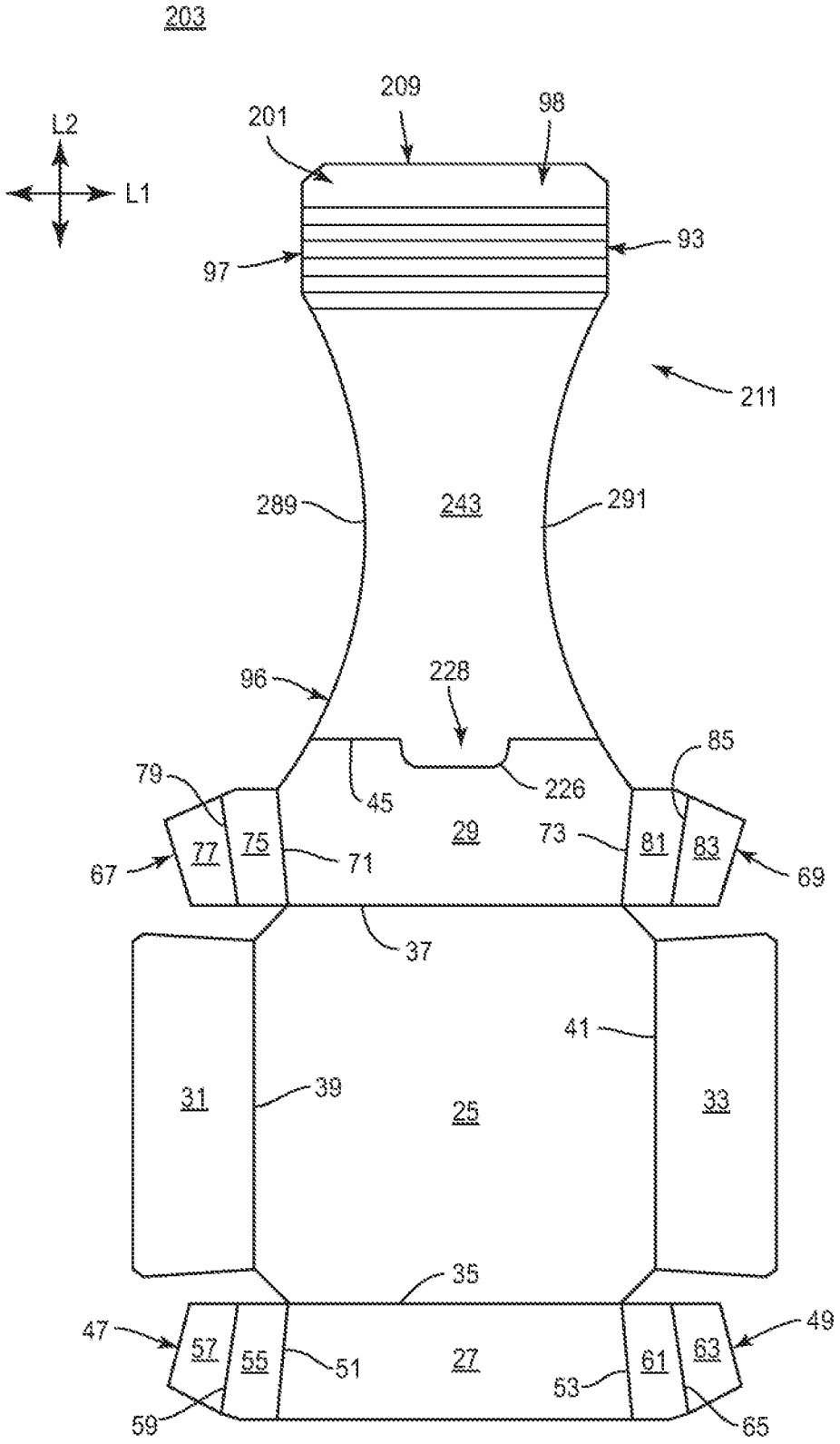
FIG. 7 is a plan view of an exterior surface of a blank for forming a carton according to a third exemplary embodiment of the disclosure.

Turning to FIG. 7, an exterior surface 201 of a blank 203 for forming a carton 205 (FIG. 8) according to a third exemplary embodiment of the disclosure is illustrated. The blank 203 and the carton 205 have one or more features that are similar to the blanks 3, 103 and the cartons 5, 105 of the respective first and second exemplary embodiments, and identical or similar features are identified with identical or similar reference numerals. The carton 205 includes a tray 208 and a reclosable lid 209 foldably attached to the tray 208 and having article retention features 211. In one embodiment, the carton 205 is sized to hold four articles F in a 2×2 arrangement, but the carton 205 could be sized to hold other quantities of articles in various arrangements without departing from the disclosure.

As shown, the blank 203 has the longitudinal axis L1 and the lateral axis L2. The lid 209 of the carton 205 is formed from a top panel 243 that includes curved notches 289, 291 at respective free edge portions thereof that form the article retention features 211. The plurality of longitudinal fold lines 93 is formed at the distal portion 97 of the top panel 243. As also shown, the longitudinal fold line 45 that foldably connects the top panel 243 to the back panel 29 is interrupted by a cut 226 that extends between portions of the fold line 45 and the back panel 29 and defines a support tab 228 that protrudes from the top panel 243 to form a support, as described further below.

Figure 8:
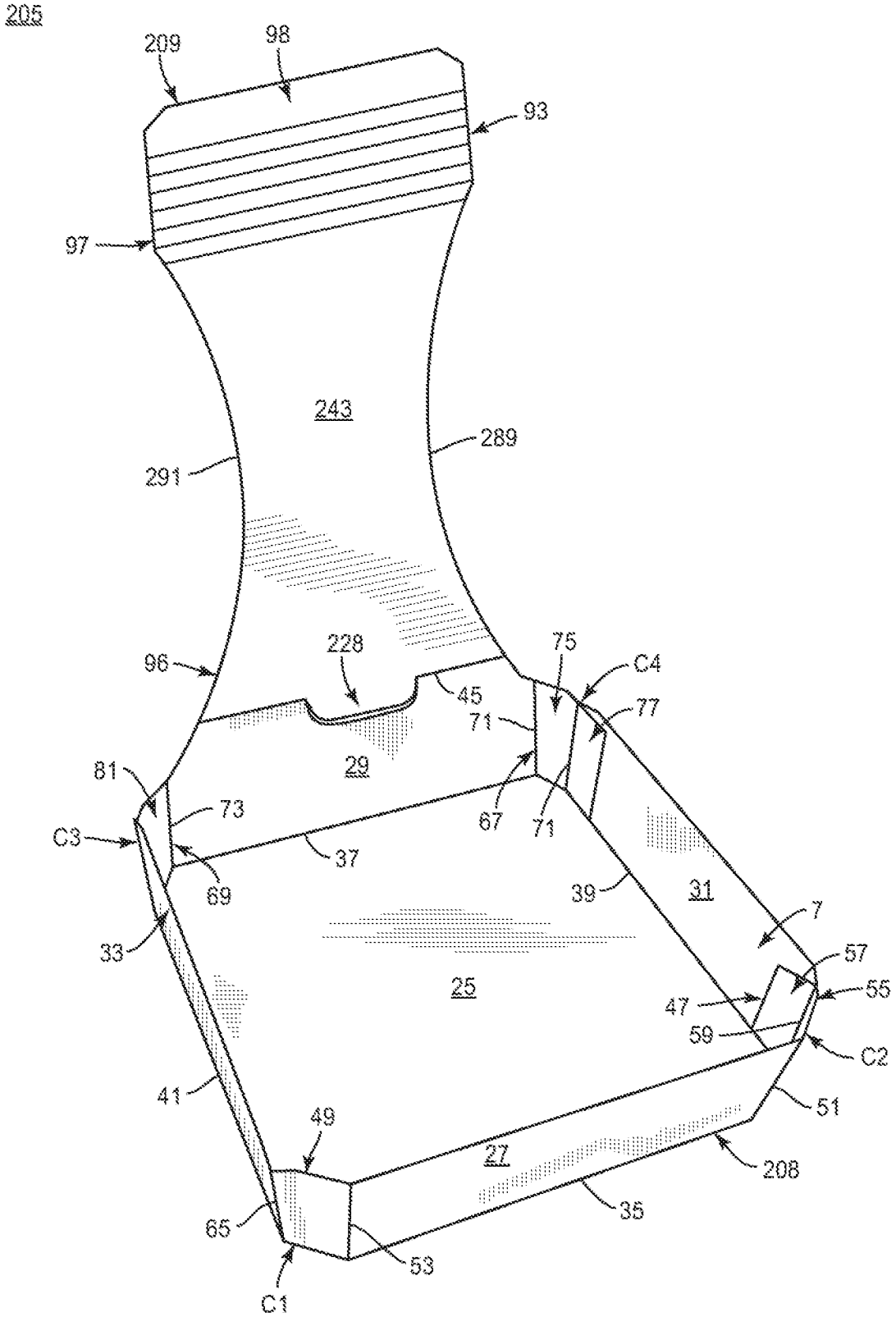
FIG. 8 is a perspective view of a carton formed from the blank of FIG. 7 according to the third exemplary embodiment of the disclosure and in an open configuration.

As shown in FIG. 8, in one embodiment, the panels 25, 27, 29, 31, 33 can be at least partially folded around the interior 7 of the carton 205 in a manner similar to that described above with regard to the cartons 5, 105 to form the tray 208 of the carton 205 from the blank 203.

In a first or open configuration of the carton 205, the lid 209 can be raised above the tray 208, e.g., above the upper edges of the panels 27, 29, 31, 33, such that the interior 7 of the carton 205 is accessible, and one or more articles F (FIG. 9) can be placed in the interior 7 of the carton 205, and with the corners C1, C2, C3, C4 contoured to conform to a configuration of the articles F.

Figure 9:
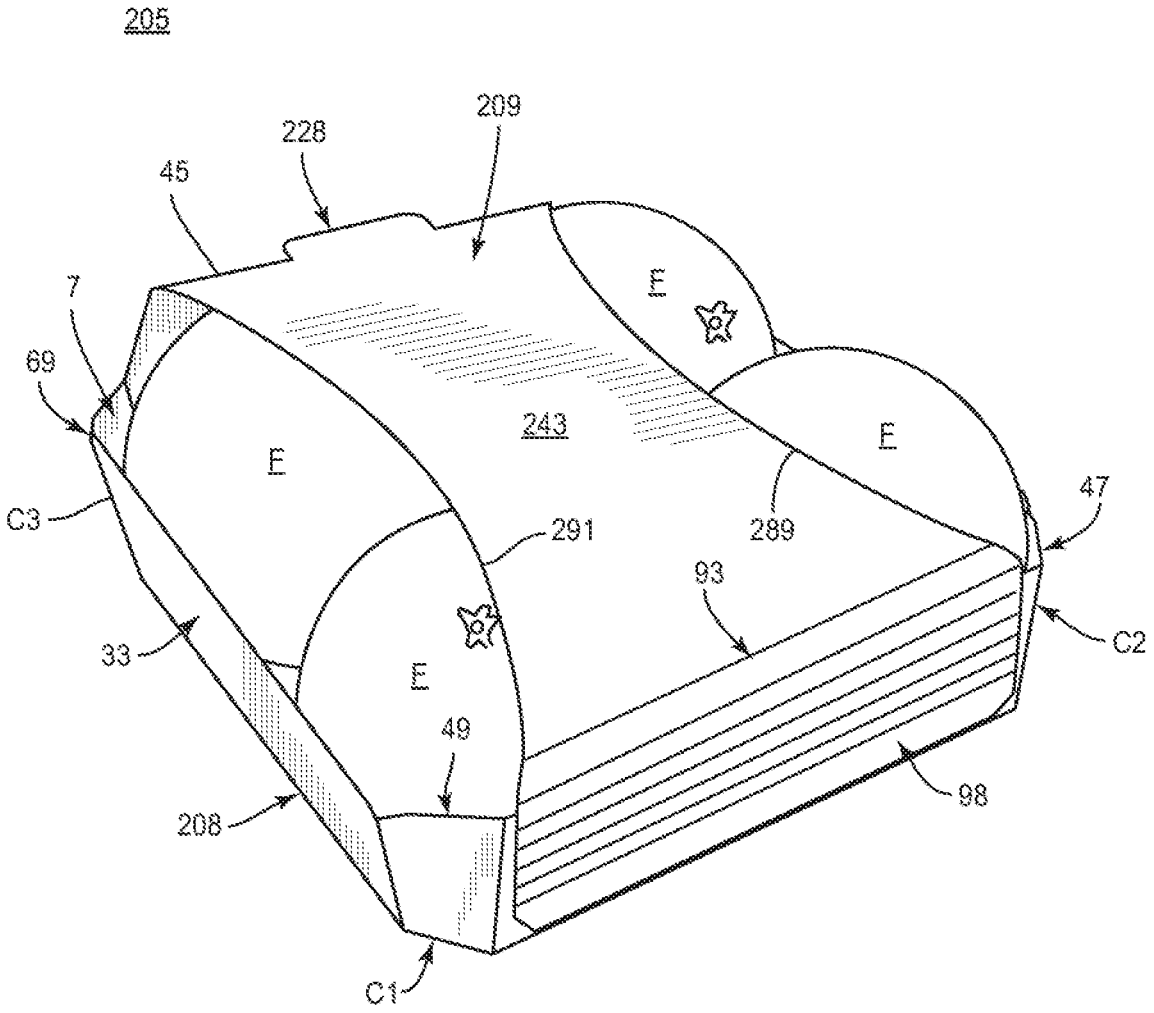
FIG. 9 is a perspective view of the carton of FIG. 8 in a closed configuration.

As shown in FIG. 9, the lid 209 can be folded downwardly at the fold line 45 to at least partially cover the tray 208 and the interior 7 of the carton 205 in a second or closed configuration of the carton 205. As shown, the top panel 243 can at least partially bend, curve, or contour via relative folding of portions of the top panel 243 at the plurality of fold lines 93, for example, to contour to a portion of one or more articles F in the carton 205. As also shown, the attachment portion 98 of the top panel 243 can be positioned in face-to-face contact with the front panel 27 and secured thereto, for example, with an adhesive such as glue and/or with closure or locking features, to maintain the closed configuration of the carton 205. In order to open the carton 205 from such an arrangement, the top panel 243 can be separated from the front panel 27.

As illustrated, the article retention features 211 are configured to retain one or more articles F in the carton 205 such that the respective curved notches 289, 291 engage a portion of the articles F. In this regard, the article retention features 211 receive and/or engage the one or more articles F to retain the one or more articles F in the interior 7 of the carton 205 and/or to maintain the relative positioning of the one or more articles F in the carton 205. Additionally, the configuration of the article retention features 211 is such that one or more portions of the articles F can protrude therethrough, for example, to provide areas of inspection or visibility of the articles F for a customer. In one embodiment, the articles F are positioned at or adjacent a respective corner C1, C2, C3, C4 of the carton 205.

In the illustrated embodiment, in the closed configuration of the carton 205, downward folding of the top panel 243 causes the support tab 228 to separate from the back panel 229 at the cut 226 to extend outwardly from the carton 205. In this regard, the support tab 228 presents a protruding surface for engaging a supporting structure in a retail space, for example, a ledge of a retail shelf or other surface. In this regard, the tab 228 can engage a supporting structure to support the carton 205 in a display position wherein the carton 205 is raised, e.g., oblique with respect to a horizontal line-of-sight, so that the articles F are more visible to a customer. Further, indicia or other graphics printed or displayed on the top panel 243 can be more visible to a consumer or customer in the display position of the carton 205.

Figure 10:
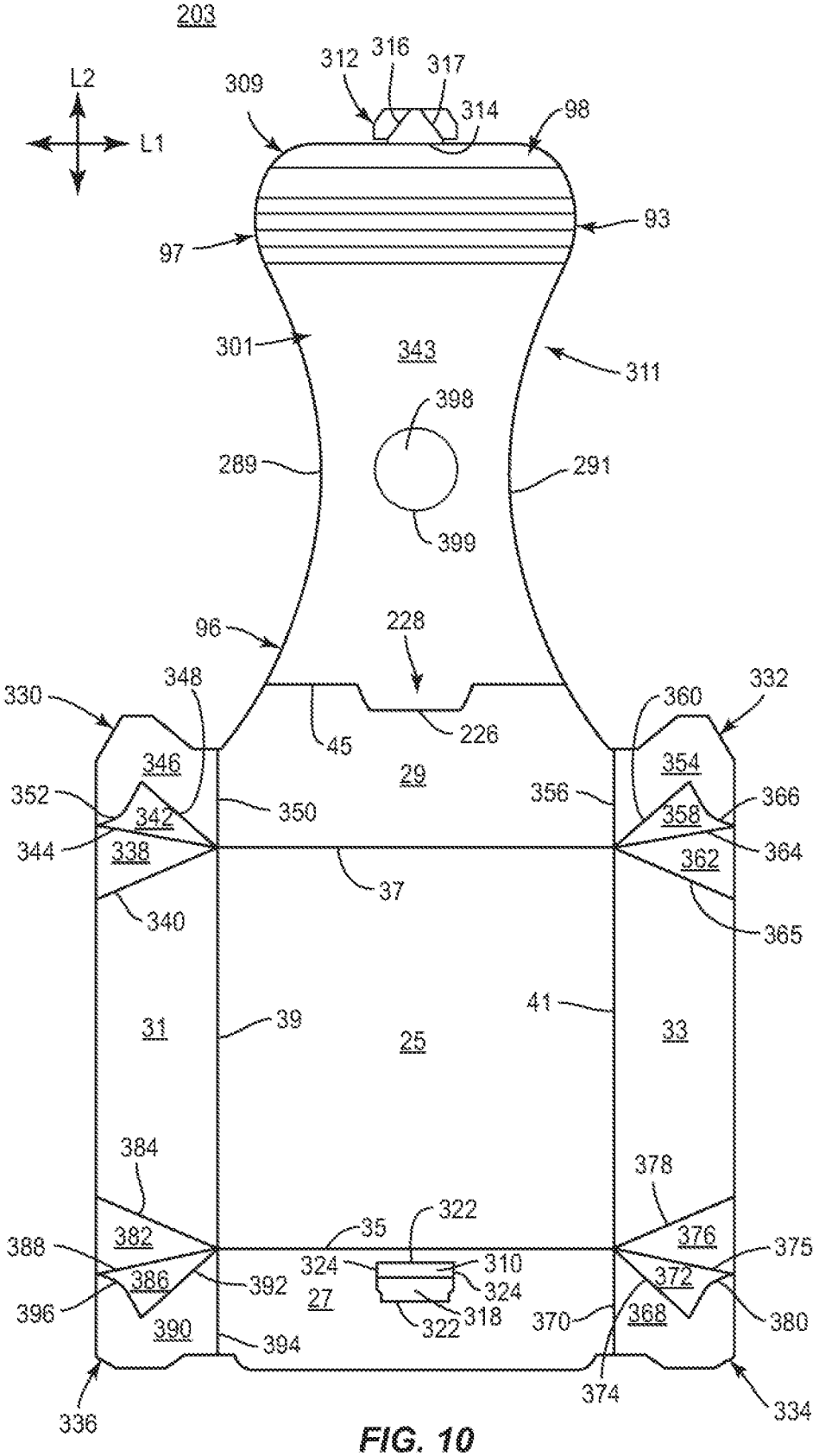
FIG. 10 is a plan view of an exterior surface of a blank for forming a carton according to a fourth exemplary embodiment of the disclosure.

FIG. 10 illustrates an exterior surface 301 of a blank 303 for forming a carton 305 (FIG. 11) according to a fourth exemplary embodiment of the disclosure. The blank 303 and the carton 305 have one or more features that are similar to the blanks 3, 103, 203 and the cartons 5, 105, 205 of the respective first, second, and third exemplary embodiments, and identical or similar features are identified with identical or similar reference numerals. The carton 305 includes a tray 308 and a reclosable lid 309 foldably attached to the tray 308 and having article retention features 311. In one embodiment, the carton 305 is sized to hold four articles F in a 2×2 arrangement, but the carton 305 could be sized to hold other quantities of articles in various arrangements without departing from the disclosure.

As shown, the blank 303 has the longitudinal axis L1 and the lateral axis L2. The tray 308 of the carton 305 includes the bottom panel 25, the front panel 27, the back panel 29, the first side panel 31, and the second side panel 33. As also shown, the tray 308 includes a first gusset 330 foldably connected to each of the first side panel 31 and the back panel 29, a second gusset 332 foldably connected to each of the back panel 29 and the second side panel 33, a third gusset 334 foldably connected to each of the second side panel 33 and the front panel 27, and a fourth gusset 336 foldably connected to each of the front panel 27 and the first side panel 31. The gussets 334, 336, 332, 330 at least partially form the respective corners C1, C2, C3, C4 of the tray 308.

As shown in FIG. 10, the first gusset 330 includes a first gusset panel 338 foldably connected to the first side panel 31 at an oblique fold line 340, a second gusset panel 342 at least partially foldably connected to the first gusset panel 338 at an oblique fold line 344, and a third gusset panel 346 at least partially foldably connected to the second gusset panel 342 at an oblique fold line 348 and foldably connected to the back panel 29 at lateral fold line 350. A curved cut 352, as shown, extends from an end of the oblique fold line 348, intersects an end of the oblique fold line 344, and extends to a free edge of the gusset 330 to provide at least partial separability between the first gusset panel 338 and the third gusset panel 346, with the second gusset panel 342 at least partially separable from the first gusset panel 338 and the third gusset panel 346 by respective portions of the cut 352. In one embodiment, the cut 352 can intersect the fold line 344 at or near a free edge of the gusset 330.

In one embodiment, the second gusset 332 includes a first gusset panel 354 foldably connected to the back panel 29 at a lateral fold line 356, a second gusset panel 358 at least partially foldably connected to the first gusset panel 354 at an oblique fold line 360, and a third gusset panel 362 at least partially foldably connected to the second gusset panel 358 at an oblique fold line 364 and foldably connected to the second side panel 33 at an oblique fold line 365. A curved cut 366, as shown, extends from an end of the oblique fold line 360, intersects an end of the oblique fold line 364, and extends to a free edge of the gusset 332 to provide at least partial separability between the first gusset panel 354 and the third gusset panel 362, with the second gusset panel 358 at least partially separable from the first gusset panel 354 and the third gusset panel 362 by respective portions of the cut 366. In one embodiment, the cut 366 can intersect the fold line 364 at or near a free edge of the gusset 332.

In one embodiment, the third gusset 334 includes a first gusset panel 368 foldably connected to the front panel 27 at a lateral fold line 370, a second gusset panel 372 at least partially foldably connected to the first gusset panel 368 at an oblique fold line 374, and a third gusset panel 376 at least partially foldably connected to the second gusset panel 372 at an oblique fold line 375 and foldably connected to the second side panel 33 at an oblique fold line 378. A curved cut 380, as shown, extends from an end of the oblique fold line 374, intersects an end of the oblique fold line 375, and extends to a free edge of the gusset 334 to provide at least partial separability between the first gusset panel 368 and the third gusset panel 376, with the second gusset panel 372 at least partially separable from the first gusset panel 368 and the third gusset panel 376 by respective portions of the cut 380. In one embodiment, the cut 380 can intersect the fold line 375 at or near a free edge of the gusset 334.

The fourth gusset 336 can include a first gusset panel 382 foldably connected to the first side panel 31 at an oblique fold line 384, a second gusset panel 386 at least partially foldably connected to the first gusset panel 382 at an oblique fold line 388, and a third gusset panel 390 at least partially foldably connected to the second gusset panel 386 at an oblique fold line 392 and foldably connected to the front panel 27 at a lateral fold line 394. A curved cut 396, as shown, extends from an end of the oblique fold line 392, intersects an end of the oblique fold line 388, and extends to a free edge of the gusset 336 to at least partially separate the first gusset panel 382 and the third gusset panel 390, with the second gusset panel 386 at least partially separated from the first gusset panel 382 and the third gusset panel 390 by respective portions of the cut 396. In one embodiment, the cut 396 can intersect the fold line 388 at or near a free edge of the gusset 336.

The gussets 330, 332, 334, 336 could be otherwise shaped, arranged, configured and/or omitted without departing from the scope of the disclosure.

The lid 309 of the carton 305 is formed from a top panel 343 that includes the curved notches 289, 291 at free edge portions thereof and that form the article retention features 311. The plurality of longitudinal fold lines 93 is formed at the distal portion 97 of the top panel 343. As also shown, the longitudinal fold line 45 that foldably connects the top panel 243 to the back panel 29 is interrupted by the cut 226 that extends into a portion of the back panel 29 and that defines the tab 228 that protrudes from the top panel 343. A handle feature of the carton 305 includes an opening 398 formed in the top panel 343 with a circular edge 399, and can accommodate, for example, a one or more of a customer's fingers, to facilitate carrying of the carton 305. Other embodiments of the cartons 5, 105, 205 described above could have an identical or similar opening 398 without departing from the disclosure.

Still referring to FIG. 10, the attachment features of the carton 305 includes locking features that includes a locking tab 312 foldably connected to the top panel 343 at a fold line 314 and including a pair of intersecting oblique fold lines 316, 317, for example, to provide flexible reconfiguration of the locking tab 312 during use as described below. The locking tab 312 is configured to be at least partially inserted through a locking opening 318 defined in the front panel 27. As shown, a locking ledge 310 is foldably connected to the front panel 27 at a longitudinal fold line 322, and is at least partially separable from the front panel 27 at a pair of cuts 324, for example, to provide for flexion relative to the front panel 27 during operation.

Figure 11:
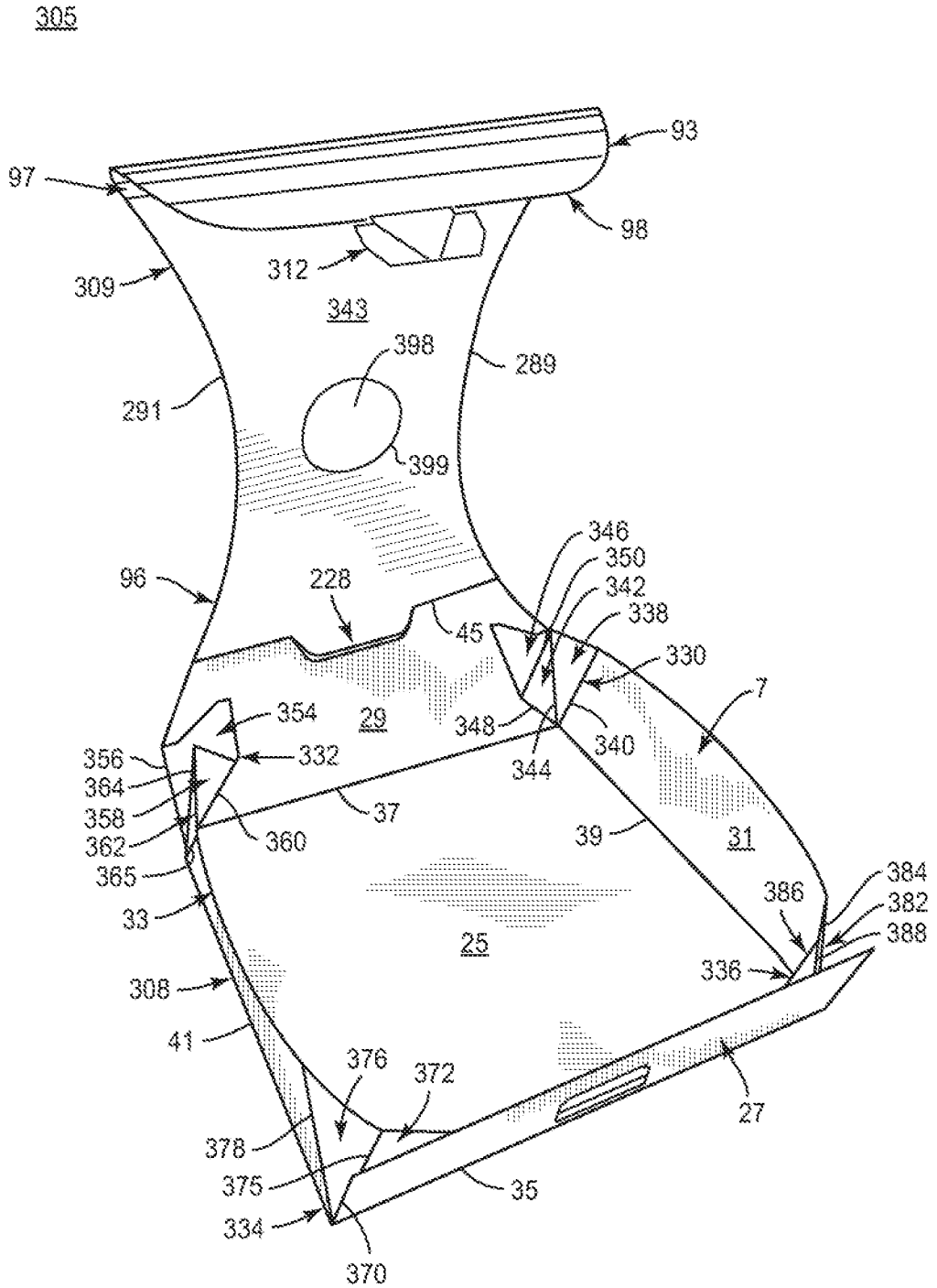
FIG. 11 is a perspective view of a carton formed from the blank of FIG. 10 according to the fourth exemplary embodiment of the disclosure and in an open configuration.

As shown in FIG. 11, in one embodiment, the panels 25, 27, 39, 31, 33, 43 can be at least partially folded around the interior 7 of the carton 305 in a manner similar to that described above with regard to the cartons 5, 105, 205 to form the tray 308 of the carton 305 from the blank 303. In such an arrangement, the gusset 330 can be folded at one or more of the lines 340, 344, 348, 350 such that the gusset panel 346 is in at least partial face-to-face contact with the back panel 29 and the gusset panel 338 is obliquely arranged relative to the first side panel 31, with the gusset panel 342 extending from the gusset panel 346 to the gusset panel 338. The gusset 332 can be folded at one or more of the lines 356, 360, 364, 365 such that the gusset panel 354 is in at least partial face-to-face contact with the back panel 29 and the gusset panel 363 is obliquely arranged relative to the second side panel 33, with the gusset panel 358 extending from the gusset panel 354 to the gusset panel 362. The gusset 334 can be folded at one or more of the lines 370, 374, 375, 378 such that the gusset panel 368 is in at least partial face-to-face contact with the front panel 27 and the gusset panel 376 is obliquely arranged relative to the second side panel 33, with the gusset panel 372 extending from the gusset panel 368 to the gusset panel 376. The gusset 336 can be folded at one or more of the lines 384, 388, 392, 394 such that the gusset panel 390 is in at least partial face-to-face contact with the front panel 27 and the gusset panel 382 is obliquely-disposed relative to the first side panel 31, with the gusset panel 386 extending from the gusset panel 382 to the gusset panel 390. Such arrangement of the gussets 380, 382, 384, 386 can be maintained, for example, with an adhesive such as glue.

In a first or open configuration of the carton 305, the lid 309 can be raised above the tray 308, e.g., above the upper edges of the panels 27, 29, 31, 33, such that the interior 7 of the carton 305 is accessible, such that one or more articles F (FIG. 12) can be placed in the interior 7 of the carton 305, and with the corners C1, C2, C3, C4 contoured to conform to a configuration of the articles F.

Figure 12:
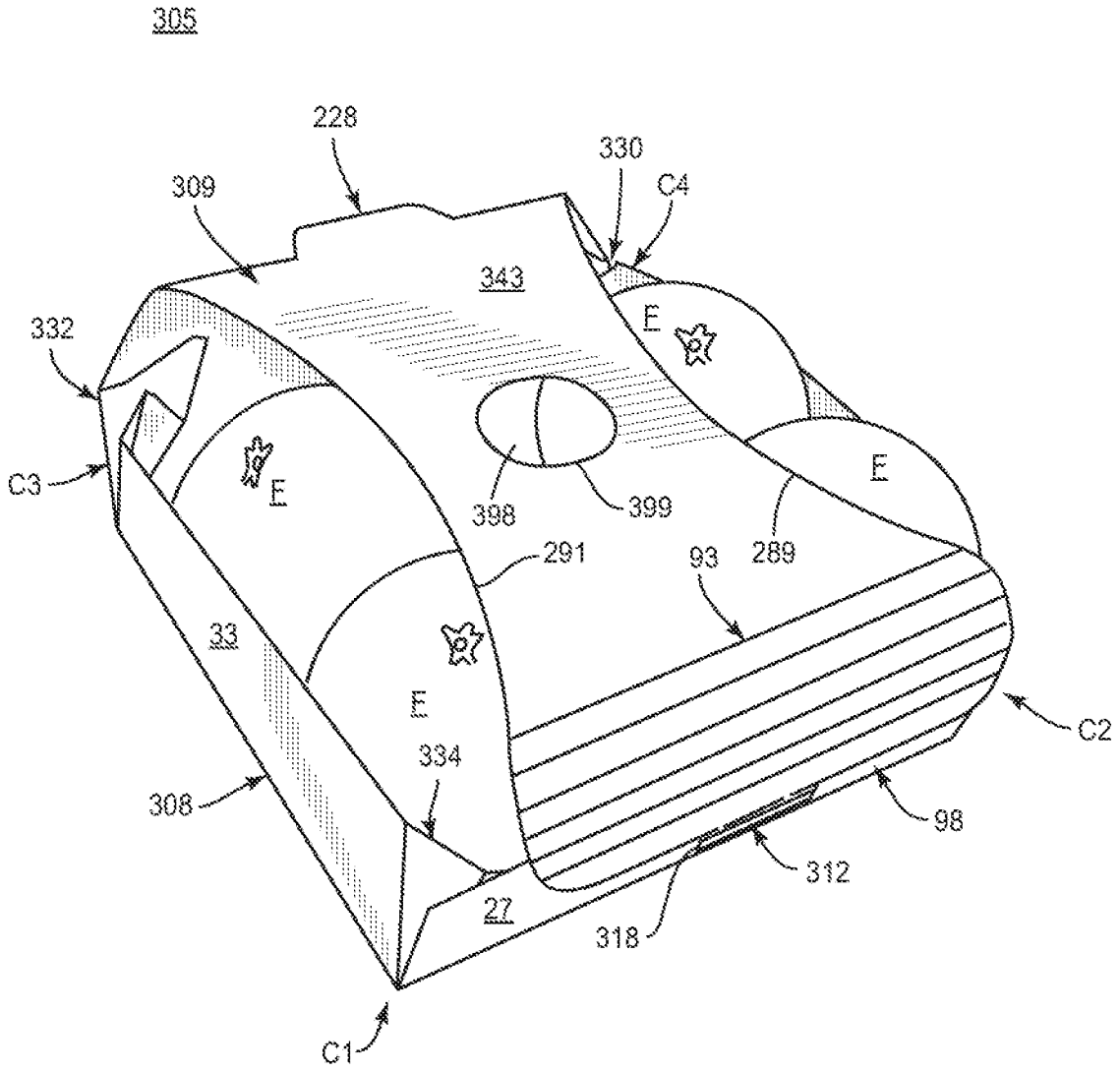
FIG. 12 is a perspective view of the carton of FIG. 11 in a closed configuration.

Referring additionally to FIG. 12, the lid 309 can be folded downwardly at the fold line 45 to at least partially cover the tray 308 and the interior 7 of the carton 305 in a second or closed configuration of the carton 305. As shown, the top panel 343 can at least partially bend, curve, or contour via relative folding of portions of the top panel 343 at the plurality of fold lines 93, for example, to contour to a portion of one or more articles F in the carton 305. As also shown, the locking tab 312 can be inserted at least partially through the locking opening 318 in the front panel 27 to maintain the closed configuration of the carton 305. In such an arrangement, the locking tab 312 can be positioned in at least partial face-to-face contact with the locking ledge 310. The carton 305 can be subsequently opened, for example, by disengaging the locking tab 312 from the locking opening 318 and raising the lid 309 relative to the tray 308.

As illustrated, the article retention features 311 are configured to retain one or more articles F in the carton 305 such that the respective curved notches 289, 291 engage a portion of the articles F. In this regard, the article retention features 311 receive and/or engage the one or more articles F to retain the one or more articles F in the interior 7 of the carton 305 and/or to maintain the relative positioning of the one or more articles F in the carton 305. Additionally, the configuration of the article retention features 311 is such that one or more portions of the articles F can protrude therethrough, for example, to provide areas of inspection or visibility of the articles F for a customer. In one embodiment, the articles F are positioned at or adjacent a respective corner C1, C2, C3, C4 of the carton 305.

In the various illustrated embodiments, the cartons 5, 105, 205, 305 are provided such that a respective integral lid 9, 109, 209, 309 is provided in a unitary or one-piece construction with the respective tray 8, 108, 208, 308 of the respective cartons 5, 105, 205, 305 such that material savings can be realized. As described herein, the respective lids 9, 109, 209, 309 are configured with respective article retention features 11, 111, 211, 311 that retain at least one article F therein while also allowing such articles F to be viewed by a customer. The cartons 5, 105, 205, 305 could have other features and could be otherwise shaped arranged, and/or configured without departing from the disclosure. For example, the pluralities of fold lines 93, 95, 193, 195 discussed above as facilitating bending or curving of the respective lids could be omitted so that the respective lids can be curved or bent in accordance with their material properties.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels that extends at least partially around an interior of the carton, the plurality of panels comprising a bottom panel, a front panel, a back panel, at least one side panel, and a top panel, the top panel comprises a first plurality of fold lines positioned at a distal portion of the top panel, and the top panel further comprises a second plurality of fold lines positioned at a proximal portion of the top panel;

a tray formed from the bottom panel, the front panel, the back panel, and the at least one side panel, the tray for at least partially receiving the at least one article; and a lid formed from the at least one top panel, the lid having at least one article engaging feature comprising a curved notch at a free edge portion of the top panel for engaging the at least one article, the lid is foldably connected to the back panel and is moveable between an open configuration, in which the lid is raised above the tray such that the at least one article is accessible in the interior of the carton, and a closed configuration, in which the lid is lowered into engagement with an exterior surface of the front panel of the tray such that the at least one article engaging feature engages the at least one article in the closed configuration and such that the first plurality of fold lines and the second plurality of fold lines extend across a respective portion of the lid in the closed configuration.

2. The carton of claim 1, wherein the curved notch is positioned to engage at least a portion of the at least one article.

3. The carton of claim 2, wherein the curved notch is a first curved notch and the free edge portion of the top panel is a first free edge portion of the top panel, and the at least one article engaging feature further comprises a second curved notch at a second free edge portion of the top panel opposite the first free edge portion.

4. The carton of claim 2, wherein the at least one article engaging feature comprises an opening in the top panel.

5. The carton of claim 1, wherein the top panel comprises an attachment feature, and wherein, in the closed configuration, the attachment feature engages a portion of the front panel.

6. The carton of claim 5, wherein the attachment feature comprises an attachment portion in the distal portion of the top panel defined between the first plurality of fold lines and a free edge of the top panel, and wherein, in the closed configuration, the attachment portion of the top panel is in at least partial face-to-face contact with the front panel.

7. The carton of claim 5, wherein the attachment feature comprises a locking tab foldably connected to the top panel, and the front panel comprises a locking opening in the front panel for receiving the locking tab in the closed configuration.

8. The carton of claim 1, wherein the lid comprises a plurality of article retention sections.

9. The carton of claim 8, wherein the at least one article engaging feature comprises a curved notch between respective adjacent article retention sections.

10. The carton of claim 9, wherein the plurality of article retention sections comprises a first article retention section foldably connected to the back panel, a second article retention section, a third article retention section, and a fourth article retention section, each of the first article retention section, the second article retention section, the third article retention section, and the fourth article retention section extending from a central section of the top panel.

11. The carton of claim 10, wherein the first article retention section comprises the second plurality of fold lines, and at least one of the second article retention section, the third article retention section, and the fourth article retention section comprises the first plurality of fold lines.

12. The carton of claim 10, wherein the second article retention section, the third article retention section, and the fourth article retention section each comprise a respective attachment portion at a respective distal portion of the top panel.

13. The carton of claim 12, wherein the respective attachment portion is attached to a respective panel of the plurality of panels in the closed configuration of the carton.

14. The carton of claim 1, further comprising a support, wherein in the closed configuration of the carton, the support protrudes outwardly from the back panel for engaging a surface.

15. The carton of claim 14, wherein the support comprises a support tab at least partially defined by a cut extending between portions of a fold line foldably connecting the lid and the back panel.

16. The carton of claim 1, wherein the top panel comprises a handle feature.

17. The carton of claim 1, wherein the at least one side panel is a first side panel, the plurality of panels further comprises a second side panel, each of the first side panel, the second side panel, the front panel, and the back panel are foldably connected to the bottom panel and obliquely arranged relative to the bottom panel.

18. A blank for forming a carton for holding at least one article, the blank comprising:

a plurality of panels for extending at least partially around an interior of the carton formed from the blank, the plurality of panels comprising a bottom panel, a front panel, a back panel, at least one side panel, and a top panel, the top panel comprises a first plurality of fold lines positioned at a distal portion of the top panel, and the top panel further comprises a second plurality of fold lines positioned at a proximal portion of the top panel;

the bottom panel, the front panel, the back panel, and the at least one side panel for forming a tray in the carton formed from the blank, the tray for at least partially receiving the at least one article; and the at least one top panel for forming a lid in the carton formed from the blank, the lid having at least one article engaging feature comprising at least one curved notch at a free edge portion of the top panel for engaging the at least one article, the lid is foldably connected to the back panel such that when the carton is formed from the blank the lid is positionable between an open configuration, in which the lid is raised above the tray such that the at least one article is accessible in the interior of the carton formed from the blank, and a closed configuration, in which the lid is lowered into engagement with an exterior surface of the front panel of the tray such that the at least one article engaging feature engages the at least one article in the closed configuration of the carton formed from the blank and such that the first plurality of fold lines and the second plurality of fold lines extend across a respective portion of the lid in the closed configuration of the carton formed from the blank.

19. The blank of claim 18, wherein the at least one curved notch is a first curved notch at a first free edge portion of the top panel, and the at least one curved notch comprises a second curved notch at a second free edge portion of the top panel opposite the first free edge portion.

20. The blank of claim 18, wherein the at least one article engaging feature comprises an opening in the top panel.

21. The blank of claim 18, wherein the top panel comprises an attachment feature for engaging a portion of the front panel in the carton formed from the blank.

22. The blank of claim 21, wherein the attachment feature comprises an attachment portion in the distal portion of the top panel defined between the first plurality of fold lines and a free edge of the top panel.

23. The blank of claim 21, wherein the attachment feature comprises a locking tab foldably connected to the top panel, and the front panel comprises a locking opening in the front panel for receiving the locking tab in a closed configuration of the carton formed from the blank.

24. The blank of claim 18, wherein the lid comprises a plurality of article retention sections.

25. The blank of claim 24, wherein the at least one article engaging feature comprises a curved notch between respective adjacent article retention sections.

26. The blank of claim 25, wherein the plurality of article retention sections comprises a first article retention section foldably connected to the back panel, a second article retention section, a third article retention section, and a fourth article retention section, each of the first article retention section, the second article retention section, the third article retention section, and the fourth article retention section extending from a central section of the top panel.

27. The blank of claim 26, wherein the first article retention section comprises the second plurality of fold lines, and at least one of the second article retention section, the third article retention section, and the fourth article retention section comprises the first plurality of fold lines.

28. The blank of claim 26, wherein the second article retention section, the third article retention section, and the fourth article retention section each comprise a respective attachment portion at a respective distal portion of the top panel.

29. The blank of claim 28, wherein the respective attachment portion is for being attached to a respective panel of the plurality of panels in a closed configuration of the carton formed from the blank.

30. The blank of claim 18, wherein a support tab is at least partially defined by a cut extending between respective portions of a fold line foldably connecting the lid and the back panel, the support tab forms a support extending from the back panel in a closed configuration of the carton formed from the blank.

31. The blank of claim 18, wherein the top panel comprises a handle feature.

32. The blank of claim 18, wherein the at least one side panel is a first side panel, the plurality of panels further comprises a second side panel, each of the first side panel, the second side panel, the front panel, and the back panel are foldably connected to the bottom panel and obliquely arranged relative to the bottom panel.

33. A method of forming a carton for holding at least one article, the method comprising:

obtaining a blank, the blank comprising a plurality of panels for extending at least partially around an interior of the carton, the plurality of panels comprising a bottom panel, a front panel, a back panel, at least one side panel, and a top panel foldably connected to the back panel, the top panel comprises a first plurality of fold lines positioned at a distal portion of the top panel, and the top panel further comprises a second plurality of fold lines positioned at a proximal portion of the top panel;

at least partially folding the bottom panel, the front panel, the back panel, and the at least one side panel to form a tray, the tray for at least partially receiving the at least one article; and forming a lid from the at least one top panel such that the lid is moveable between an open configuration, in which the lid is raised above the tray such that the at least one article is accessible in the interior of the carton, and a closed configuration, in which the lid is lowered into engagement with an exterior surface of the front panel of the tray and such that the first plurality of fold lines and the second plurality of fold lines extend across a respective portion of the lid, the lid having at least one article engaging feature comprising at least one curved notch at a free edge portion of the top panel for engaging the at least one article when the lid is lowered into the closed configuration.

34. The method of claim 33, wherein the at least one curved notch is positioned to engage at least a portion of the at least one article.

35. The method of claim 34, wherein the at least one curved notch is a first curved notch at a first free edge portion of the top panel, and the at least one curved notch comprises a second curved notch at a second free edge portion of the top panel opposite the first free edge portion.

36. The method of claim 34, wherein the at least one article engaging feature comprises an opening in the top panel.

37. The method of claim 33, wherein the top panel comprises an attachment feature, and wherein, in the closed configuration, the attachment feature engages a portion of the front panel.

38. The method of claim 37, wherein the attachment feature comprises an attachment portion in the distal portion of the top panel defined between the first plurality of fold lines and a free edge of the top panel, and wherein, in the closed configuration, the attachment portion of the top panel is in at least partial face-to-face contact with the front panel.

39. The method of claim 37, wherein the attachment feature comprises a locking tab foldably connected to the top panel, and the front panel comprises a locking opening in the front panel for receiving the locking tab in the closed configuration.

40. The method of claim 33, wherein the lid comprises a plurality of article retention sections.

41. The method of claim 40, wherein the at least one article engaging feature comprises a curved notch between respective adjacent article retention sections.

42. The method of claim 41, wherein the plurality of article retention sections comprises a first article retention section foldably connected to the back panel, a second article retention section, a third article retention section, and a fourth article retention section, each of the first article retention section, the second article retention section, the third article retention section, and the fourth article retention section extending from a central section of the top panel.

43. The method of claim 42, wherein the first article retention section comprises the second plurality of fold lines, and at least one of the second article retention section, the third article retention section, and the fourth article retention section comprises the first plurality of fold lines.

44. The method of claim 42, wherein the second article retention section, the third article retention section, and the fourth article retention section each comprise a respective attachment portion at a respective distal portion of the top panel.

45. The method of claim 44, wherein the respective attachment portion is attached to a respective panel of the plurality of panels in the closed configuration of the carton.

46. The method of claim 33, further comprising a support, wherein in the closed configuration of the carton, the support protrudes outwardly from the back panel for engaging a surface.

47. The method of claim 46, wherein the support comprises a support tab at least partially defined by a cut extending between respective portions of a fold line foldably connecting the lid and the back panel.

48. The method of claim 33, wherein the top panel comprises a handle feature.

49. The method of claim 33, wherein the at least one side panel is a first side panel, the plurality of panels further comprises a second side panel, each of the first side panel, the second side panel, the front panel, and the back panel are foldably connected to the bottom panel and obliquely arranged relative to the bottom panel.

* * * * *